US006148625A

United States Patent [19]

Camp et al.

[11] Patent Number: 6,148,625

[45] Date of Patent: Nov. 21, 2000

[54] FROST AND FREEZE-UP PREVENTION CONTROL SYSTEM FOR IMPROVING COOLING SYSTEM EFFICIENCY IN VENDING MACHINES

[76] Inventors: Vernon D. Camp, 7222 Igou Ferry Rd., Harrison, Tenn. 37341; Roger I. Radpour, 9013 Old Hixson Pike, Soddy Daisy, Tenn. 37379

[21] Appl. No.: 09/309,937

[22] Filed: May 11, 1999

[51] Int. Cl.[7] ..... F25D 21/06

[52] U.S. Cl. ..... 62/155; 62/234

[58] Field of Search ..... 62/151, 152, 154, 62/155, 156, 234, 125, 126, 127, 128, 129, 176.1, 176.2

[56] References Cited

U.S. PATENT DOCUMENTS 3,518,841 7/1970 West, Jr. ..... 62/155 X
3,759,049 9/1973 Bell et al. ..... 62/155 X
3,890,798 6/1975 Fujimoto et al. ..... 62/155
5,209,076 5/1993 Kauffman et al. ..... 62/127 X
5,456,087 10/1995 Szynal et al. ..... 62/154

*Primary Examiner*—Harry B. Tanner
*Attorney, Agent, or Firm*—H. Brock Kolls

[57] ABSTRACT

The present invention relates to a frost and freezing (freeze-up) prevention control system for improving the efficiency of a cooling system commonly found in refrigerators, refrigerated vending machines, and or beverage coolers. Furthermore, the present invention can be retrofit onto, or originally manufactured into a cooling system. Suitable cooling systems are those commonly found in refrigerators, refrigerated vending machines and refrigerated beverage coolers. The present invention monitors, controls, and improves the efficiency of the refrigeration cycle by preventing the refrigerated cooling system from accumulating frost and or ice on critical cooling system components. Furthermore, by controlling the refrigeration cycle the present invention maintains a high level of cooling system efficiency and reduces the electrical power consumption required to operate the cooling system over the operational life of the cooling system.

23 Claims, 7 Drawing Sheets

500

500

100

100

200

300

400

FROST AND FREEZE-UP PREVENTION CONTROL SYSTEM FOR IMPROVING COOLING SYSTEM EFFICIENCY IN VENDING MACHINES

TECHNICAL FIELD OF THE INVENTION

The present invention relates to a frost and freezing (freeze-up) prevention control system for improving the efficiency of a cooling system commonly found in refrigerators, refrigerated vending machines, and or beverage coolers. Furthermore, the present invention can be retrofitted onto many existing refrigerated cooling systems commonly found in refrigerators, vending machines, and or refrigerated beverage coolers.

BACKGROUND OF THE INVENTION

Refrigerated cooling systems are commonly found in refrigerated vending machines and beverage coolers. Beverage coolers are small refrigerated units commonly found in convenience stores near check out aisles and high traffic areas. Growing in popularity, one of the most common uses of beverage coolers can be providing patrons with immediate access to cold beverages in the front of the store, remote areas, or other high traffic areas.

Some early beverage cooler models kept beverages cold by packing the beverages in ice. Throughout the day and at high frequency, the ice that had melted required the store clerk to drain the cooler and refill it with more ice. In many stores there are few desirable ways to drain a cooler full of ice water without making a mess. The store clerk had to either use a hose and bucket to remove the melted ice water, provide drains in the store floor, or roll the cooler outside to drain the cooler in the street or on the grounds around the store.

Other problems with early cooler technology often included requiring the customer to reach into a basin of ice and water to retrieve a beverage. This left the customer with cold wet hands, and a store clerk with a wet store floor.

An advance in beverage cooler technology has seen the addition of cooling system technology to reduce the need for large quantities of ice, and frequent cooler draining. In most cases the addition of a cooling system slows the ice melting process.

Though cooling systems can adequately cool beverages without the need for ice it can be desirable in certain situations not to eliminate the ice from the cooler. Marketing sensitivities and trends may indicate, and customers may enjoy, opening the cooler to retrieve that "ice-cold" beverage. In the case where a cooling system is used in combination with ice a desirable reduction in the amount of melted ice can be realized. This reduction of melted ice is cost effective in both ice and store clerks time by decreasing the number of occurrences in a given day the cooler must be drained.

Refrigerated cooling systems with or without the use of ice, and whether in vending machines or beverage coolers are prone to frost and freeze-up. Freeze-up is a condition where frost and or ice build up on cooling system components. As frost and or ice build up the efficiency of the cooling system diminishes until a condition exists where the temperature set by the temperature control thermostat can not be realized. In this case the cooling system continuously runs potentially causing damage to the cooling system itself.

Once freeze-up occurs the cooling system can no longer adequately or properly operate. As frost and or ice build up on cooling system components the efficiency of the cooling system diminishes. To compensate for the reduction in efficiency the cooling system runs longer and longer to try to maintain the desired refrigerated temperature. As a result electrical power consumption required by the cooling system steadily increases.

Increased electrical power consumption increases the cost of operating a vending machine or beverage cooler. A priority, Industry wide (refrigeration and vending industries) is to reduce operational electrical power consumption required by cooling systems.

Due to a number of factors including a small compartment size and a high frequency of beverage cooler lid openings, the beverage cooler can be subject to a higher frequency of freeze-ups then other refrigerated systems.

It is these deficiencies and shortcoming with current cooling systems commonly found in refrigerators, vending machines, and beverage coolers that gives rise to the present invention.

SUMMARY OF THE INVENTION

The present invention relates to a frost and freezing (freeze-up) prevention control system for improving the efficiency of a cooling system commonly found in refrigerators, refrigerated vending machines and or beverage coolers. Furthermore, the present invention can be retrofit onto, or originally manufactured into a cooling system. Suitable cooling systems are those commonly found in refrigerators, refrigerated vending machines and refrigerated beverage coolers.

The present invention monitors, controls, and improves the efficiency of the refrigeration cycle by preventing the refrigerated cooling system from accumulating frost and or ice on critical cooling system components. Furthermore, by controlling the refrigeration cycle the present invention maintains a high level of cooling system efficiency and reduces the electrical power consumption required to operate the cooling system over the operational life of the cooling system.

BRIEF DESCRIPTION OF FIGURES

The present invention is best understood from the following detailed description when read in connection with the accompanying drawings. Included in the drawings are the following Figures.

DESCRIPTION OF THE INVENTION

A number of factors can contribute to how fast and how often cooling system freeze-up can occur in a cooling system. An important factor can be how long the cooling system is allowed to run before, by way of a temperature control thermostat or other control means, the cooling system is turned OFF.

In many efficient cooling systems the system turns ON to cool the refrigerated compartment area and then turns itself OFF when the desired temperature has been reached. It can be the amount of ON time and OFF time that determines how fast and how often cooling system freeze-up occurs.

A significant reduction in electrical power consumption could be realized if the cooling system was maintained to operated at a high level of efficiency. With more than two million cold drink vending machines in service today, and an additional one million refrigerated beverage coolers in operation there is a long felt need for a solution to increase cooling system efficiency, and reduce the number and frequency of cooling system freeze-ups.

Figure 1A:
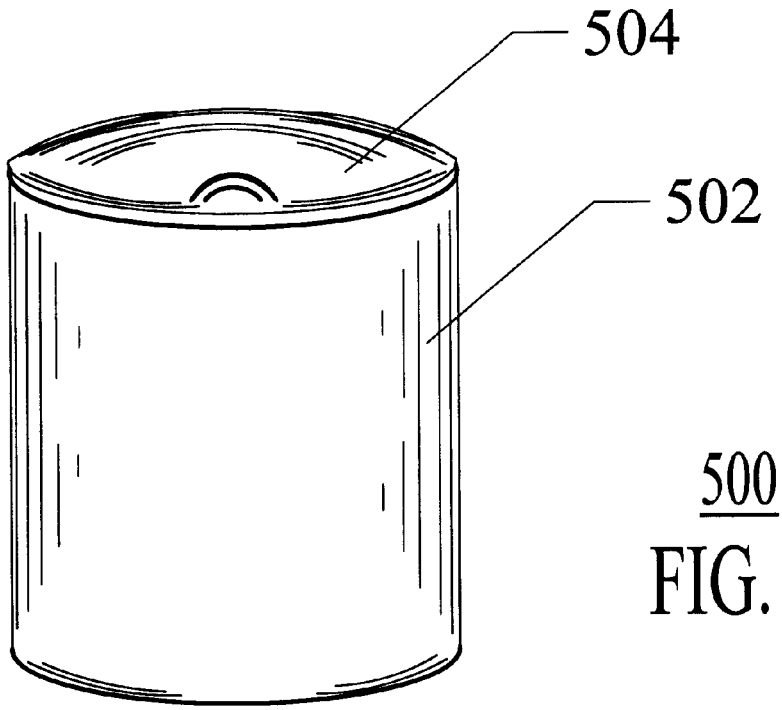
FIG. 1A shows a beverage cooler 500.

Referring to FIG. 1A there is shown a beverage cooler 500. Interconnect with a cooler body 502 is a lid 504. A beverage cooler 500 can be generally referred to as a beverage cooler, cooler, or a vending machine. A beverage cooler 500 can be a beverage cooler manufactured by or for such companies as COCA-COLA, PEPSICO, ROYAL, DIXIE NARCO, MERCHANDISING RESOURCES INC., CAVALIER or other manufactures of vending machines, snack machines, or beverage coolers.

Figure 1B:
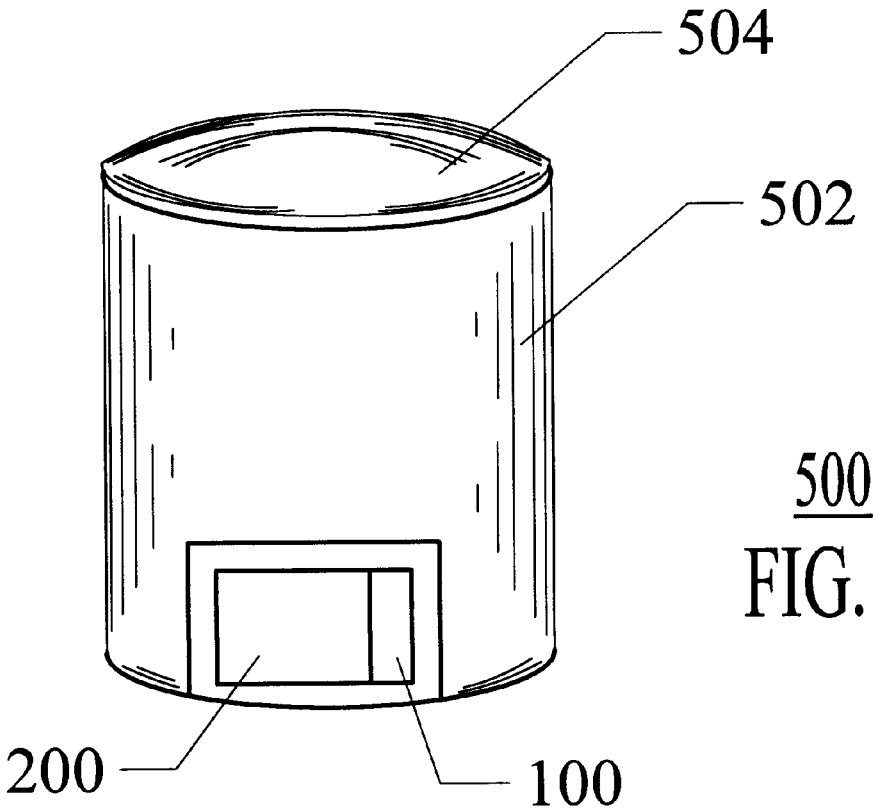
FIG. 1B shows a beverage cooler and cooling system 200.

Referring to FIG. 1B there is shown a cooling system 200 housed within a beverage cooler 500. A cooler body 502 houses a cooling system 200, and a frost and freeze-up prevention control system 100. Further, cooling system 200 is electrically interconnected with the frost and freeze-up prevention control system 100.

Figure 1C:
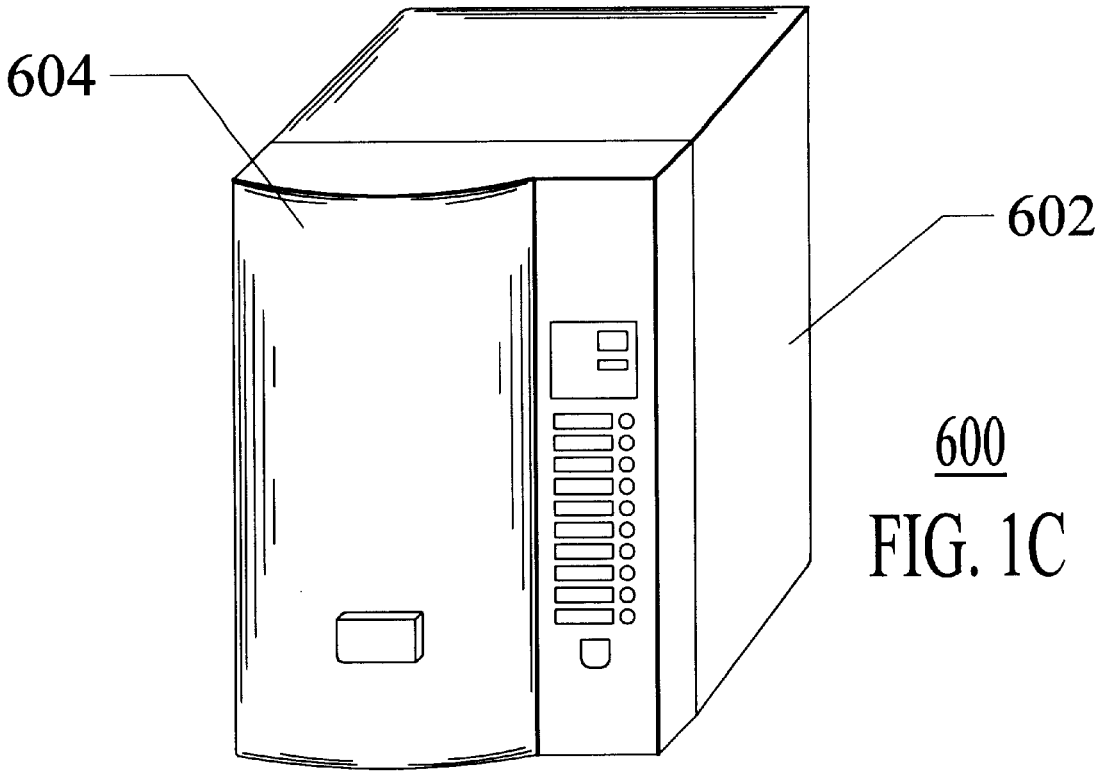
FIG. 1C shows a refrigerated vending machine 600.

Referring to FIG. 1C there is shown a vending machine 600. Interconnect with a vending machine body 602 is a door 604. A vending machine 600 can be a vending machine manufactured by or for such companies as COCA-COLA, PEPSICO, ROYAL, DIXIE NARCO, MERCHANDISING RESOURCES INC., CAVALIER or other manufactures of vending machines, snack machines, or beverage coolers. A CAVALIER vending machine part number C1052, a DIXIE NARCO vending machine part number DNCB368 can be a vending machine 600.

Figure 1D:
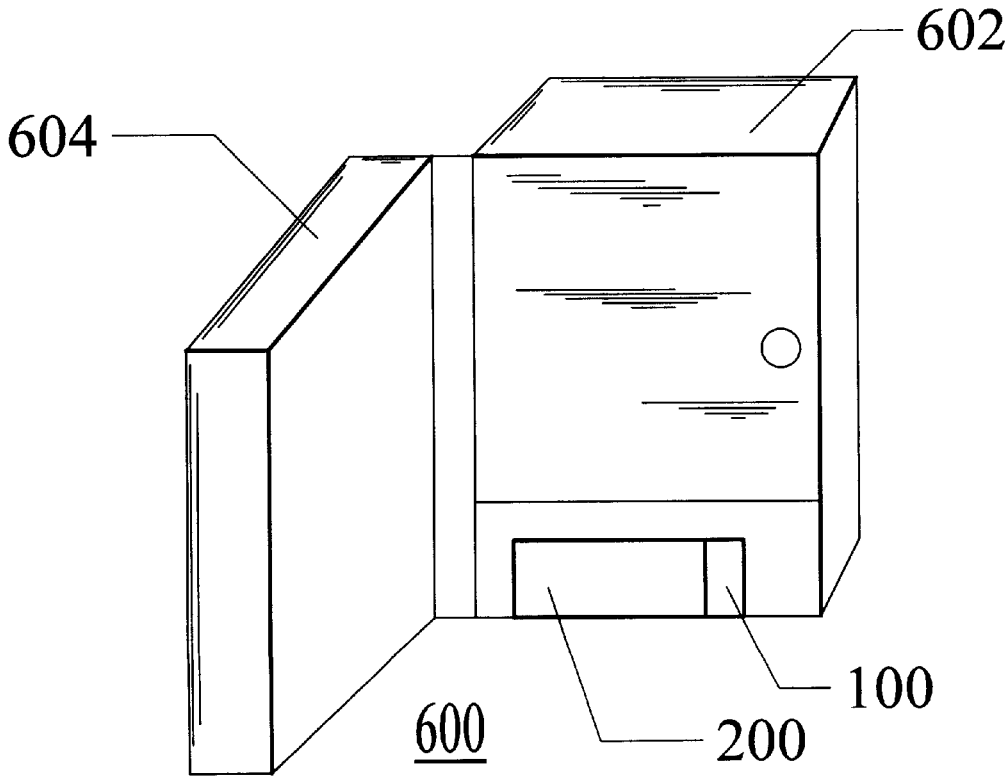
FIG. 1D shows a refrigerated vending machine and cooling system 200.

Referring to FIG. 1D there is shown a cooling system 200 housed within a vending machine 600. A vending machine body 602 houses a cooling system 200, and a frost and freeze-up prevention control system 100. Further, cooling system 200 is electrically interconnected with the frost and freeze-up prevention control system 100.

Figure 1E:
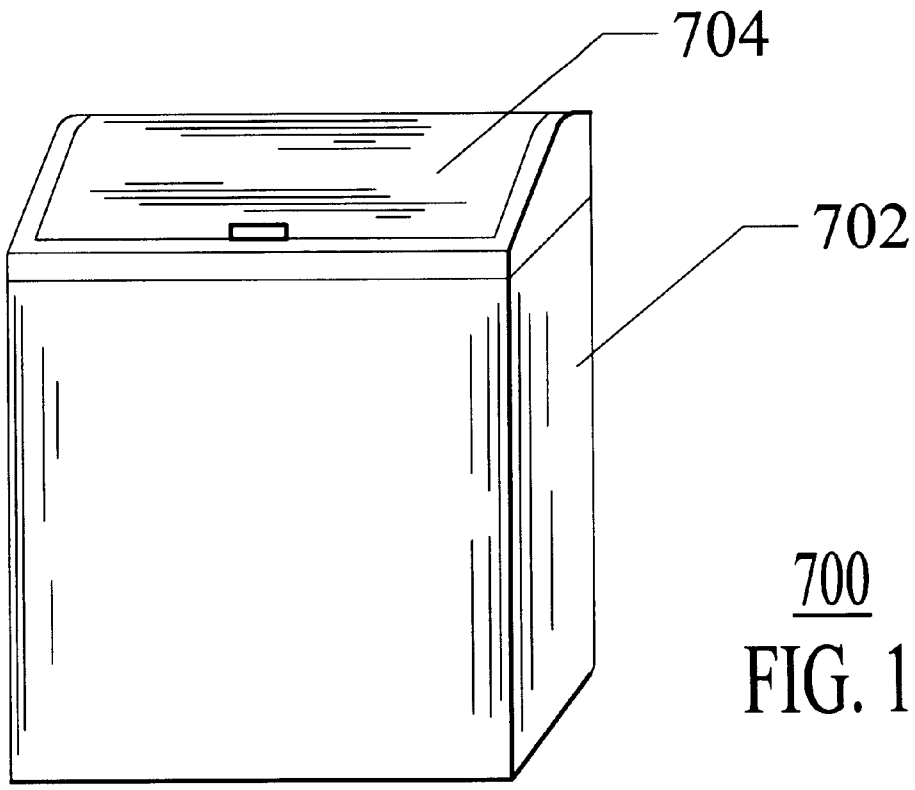
FIG. 1E shows a refrigerated pop-up beverage cooler 700.

Referring to FIG. 1E there is shown a pop-up beverage cooler 700. Interconnect with a cooler body 702 is a lid 704. A pop-up beverage cooler 700 can be generally referred to as a beverage cooler, a cooler, or a vending machine. A pop-up beverage cooler 700 can be a pop-up beverage cooler manufactured by or for such companies as COCA-COLA, PEPSICO, ROYAL, DIXIE NARCO, MERCHANDISING RESOURCES INC., CAVALIER or other manufactures of vending machines, snack machines, or beverage coolers.

Figure 1F:
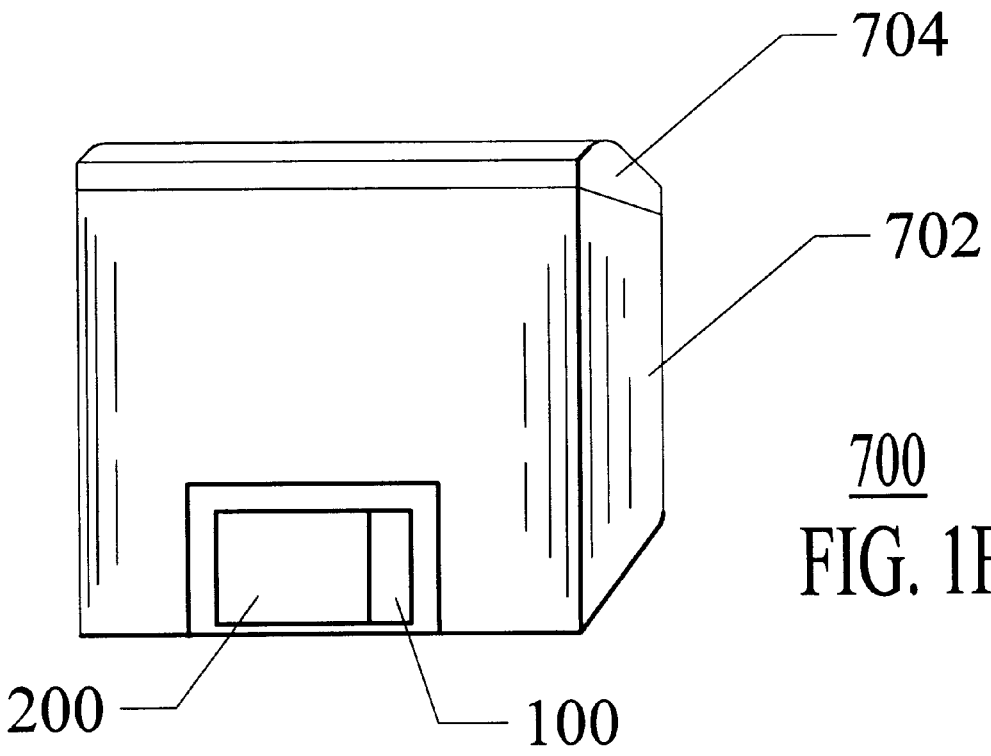
FIG. 1F shows a refrigerated pop-up beverage cooler and cooling system 200.

Referring to FIG. 1F there is shown a cooling system 200 housed within a pop-up beverage cooler 700. A cooler body 702 houses a cooling system 200, and a frost and freeze-up prevention control system 100. Further, cooling system 200 is electrically interconnected with the frost and freeze-up prevention control system 100.

For purposes of disclosure a beverage cooler 500, a vending machine 600, and a pop-up beverage cooler 700 can interchangeable be referred to as a beverage cooler, cooler, or vending machine. A vending machine can be a beverage cooler 500, or a pop up beverage cooler 700, or a snack vending machine (not shown).

Figure 2A:
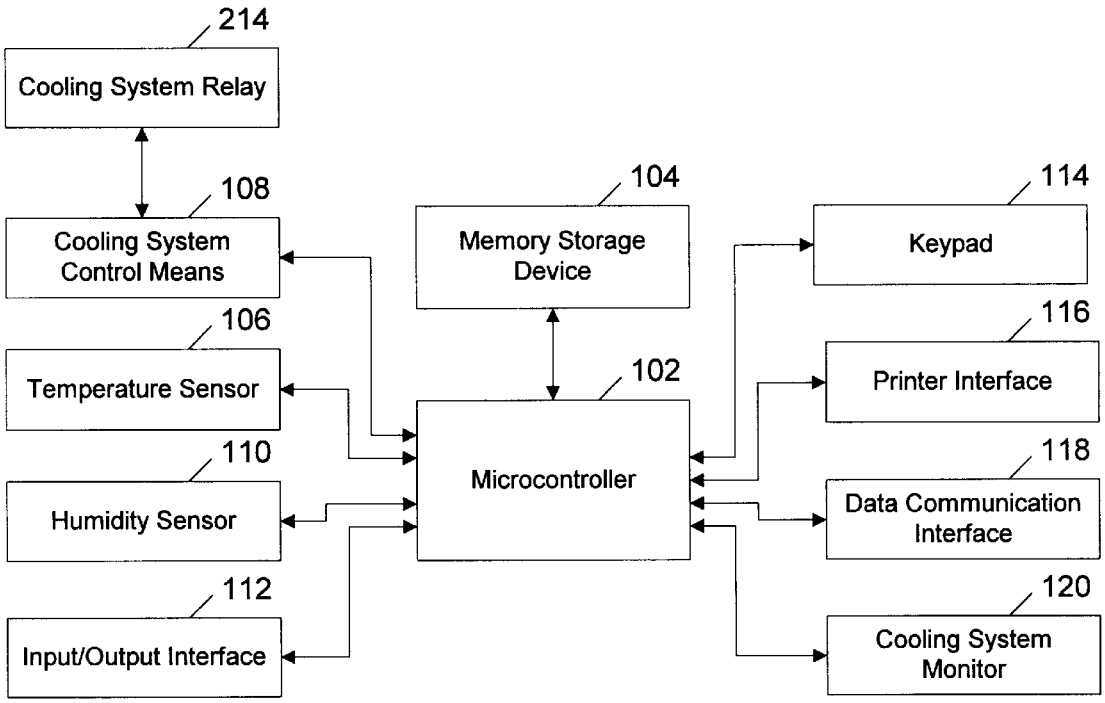
FIG. 2A shows a frost and freeze-up prevention control system 100.

Referring to FIG. 2A there is shown a frost and freeze-up prevention control system 100. A frost and freeze-up prevention control system 100 can generally be referred to as a system 100.

System 100 includes numerous mutually exclusive control means. In a plurality of embodiment specifications, and where embodiment cost considerations demand, there may arise a situation where a system 100 needs to be manufactured to include or exclude a specific combination of control means to produce the desired result at a desirable embodiment cost. For example, a customer may desire to operate a system 100 without a humidity sensor 110. In such a case a system 100 could be manufactured with the omission of a specific control means, such as humidity sensor 110. In any combination the same inclusion or exclusion of control means can be applied to other control means and to system 100 in general.

Interconnect with a microcontroller 102 is a memory storage device 104 whereby microcontroller 102 can data communicate system settings and other data with memory storage device 104. A microcontroller 102 can be a MICROCHIP part number PIC12C508, or a MICROCHIP part number PIC16C54. A memory storage device can be a MICROCHIP part number 93LC66. Preferably a memory storage device 104 is a nonvolatile device, such as the MICROCHIP 93LC66.

Figure 2B:
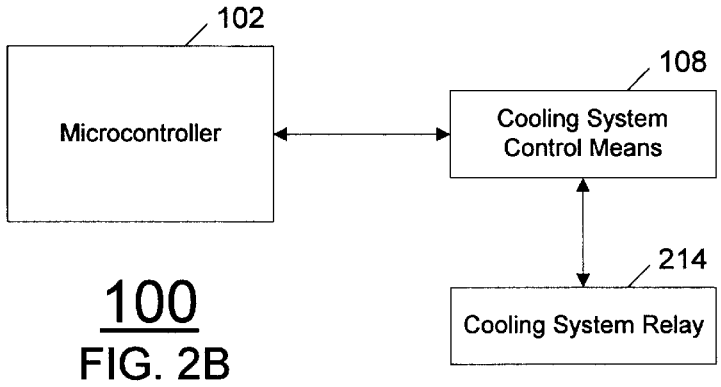
FIG. 2B shows a frost and freeze-up prevention control system 100.

In an exemplary embodiment microcontroller 102 can be programmed with all required system settings and operation programming. FIG. 2B illustrates this type of embodiment.

In another exemplary embodiment system settings can be selected or changed by a user and subsequently stored in a memory storage device 104. Further, system 100 can determine and optimize certain system performance settings, read, write or otherwise create and alter certain data resident in a memory storage device 104. An example of such data can be a MAXIMUM RUNNING TIME, a MAXIMUM OFF TIME, a TOTAL RUN TIME, and a TOTAL CYCLE TIME setting where cooling system run time and defrost time (OFF time) can be monitored and controlled.

A memory storage device 104 can also record usage data that can subsequently be printed or data communicated to other data communication devices. Usage data can include cooling system parameters such as unit temperature, compressor ON and OFF cycles, etc.

Interconnected with a microcontroller 102 can be a temperature sensor 106. A temperature sensor 106 can monitor cooling system and vending machine temperatures. Such temperature data could be recorded and otherwise utilized to optimize and monitor overall cooling system and frost and freeze-up prevention control system 100 performance. A temperature sensor can be a DALLAS part number DS1629.

Interconnected with a microcontroller 102 can be a cooling system control means 108. In an exemplary embodiment cooling system control means 108, being responsive to data communication from microcontroller 102, can be used to interrupt, enable and or disable a cooling system, such as cooling system 200. A cooling system control means 108 can be a relay driver for controlling a relay, such as cooling system relay 214. In general, by way of cooling system relay 214 and system 100 the functional operation of the entire cooling system can be managed and controlled. A cooling system control means 108 can be a QT-OPTOELECTRONICS triac opto-isolator part number MOC3021.

In an exemplary embodiment a frost and freeze-up prevention control system can be electrically connected at a first point to a temperature control thermostat, and electrically connected at a second point to a cooling system relay, such as cooling system relay 214. By way of cooling system control means 108 an electrical signal from a temperature control thermostat, such as thermostat 206 can be interrupted. Further, cooling system control means 108 can selectively allow the thermostat 206 electrical signal to electrically pass to the cooling system relay 214. When the electrical signal from thermostat 206 is interrupted cooling system 200 is effectively disabled (turned OFF). Where as, when the electrical signal from thermostat 206 is not interrupted cooling system 200 operates normally. For purposes of disclosure the term interruptible can be generally referred too as turned OFF, disabled, or disabling. Interrupting or disabling an electrical signal from thermostat 206 effectively controls the refrigeration cycle.

Interconnected with microcontroller 102 can be a humidity sensor 110. A humidity sensor 110 can monitor cooling system and vending machine humidity. Such humidity data could be recorded and otherwise utilized to optimize and monitor overall cooling system and frost and freeze-up prevention control system 100 performance. A humidity sensor 110 can be a GENERAL EASTERN part number GEI-CAP-S or GEI-CAP-V.

Interconnected with microcontroller 102 can be an input/output interface 112. An input/output interface 112 can be utilized as general-purpose system inputs and outputs. Such general-purpose system inputs and outputs can be used for expansion to other electronic devices, interfacing to cooling system control systems or for receiving other external input or providing outputs to other external devices. An input/output interface 112 can be an ALLEGRO part number UDN2595.

Interconnected with microcontroller 102 can be a keypad 114. In an exemplary embodiment a keypad 104 can be used to program, or otherwise alter the operational characteristics or performance of system 100. Further, a keypad 114 can be used to initiate system functions. Such system functions can include printing performance reports, initialization control, system settings, maintenance, testing, or other system functions or program subroutines. A keypad 114 can be implemented with a plurality of pushbuttons such as OMRON pushbutton part number B3F1000. A keypad 114 can be a single switch or push button. Further a keypad 114 can be generally referred to as a control panel, pushbutton, switch, or button.

In another exemplary embodiment a keypad 114 can be detachable from a system 100. Such a detachable keypad 114 can offer advantages of security, can reduce cost or satisfy specific customer specifications.

Interconnected with a microcontroller 102 can be a printer interface 116. A printer interface 116 can be utilized to print system data, such data that may be stored in microcontroller 102 and memory storage device 104. A printer interface 116 can be implemented with a plurality NATIONAL SEMICONDUCTOR 74LS244.

In an exemplary embodiment printed system data can include, cooling system operational performance data, system 100 operational performance data, and other overall system parameters and usage statistics.

Interconnected with microcontroller 102 can be a data communication interface 118. A data communication interface 118 can interface a system 100 to other data communicating devices. A communication interface 118 can be an RS232, RS485, modem for data communication to a remote location, carrier current, wireless, or other data communication interface. Further, a communication interface 118 can be a plurality of, and a mixed combination of RS232, RS485, modems, carrier current, wireless, or other data communicating interface. A communication interface 118 can be implemented with a MAXIM part number MAX232CSE RS232 converter and transmitter, or a MAXIM part number MAX481 RS485 converter and transmitter, or a CERMETEK CH1786LC modem.

RS232 connections include a TRANSMIT data line, a RECEIVE data line, a CLEAR TO SEND data line, a DATA TERMINAL READY data line, a DATA SET READY data line, a CARRIER DETECT data line, a RING INDICATOR data line, and a SIGNAL GROUND. RS485 connections include a DATA "A" data line, and a DATA "B" data line.

Interconnected with microcontroller 102 can be a cooling system monitor 120. A cooling system monitor 120 can monitor the ON and OFF system conditions and status of a cooling system, such as cooling system 200. In addition a cooling system monitor 120 can monitor cooling system operational parameters. Such cooling system parameters can be power consumption, TOTAL RUN TIME, TOTAL CYCLE RUN TIME, and other cooling system parameters.

Referring to FIG. 2B there is shown a modified system 100. In an exemplary embodiment only a microcontroller 102 and cooling system control means 108 are necessary to implement a frost and freeze-up prevention control system 100. In this embodiment microcontroller 102 is programmed with all processing code and all preset settings, including a MAXIMUM RUNNING TIME setting, a TOTAL RUN TIME setting, a TOTAL CYCLE RUN TIME setting, and a MAXIMUM OFF TIME setting.

Figure 3:
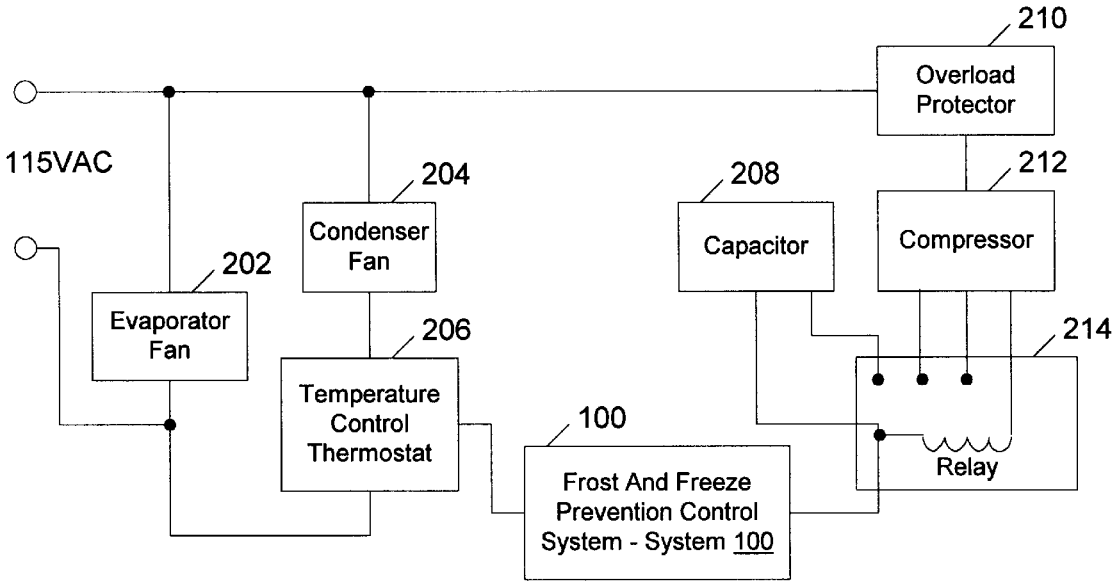
FIG. 3 shows a cooling system 200 diagram.

Referring to FIG. 3 there is shown a diagram of a cooling system 200, which includes a system 100. System 100 can be retrofit onto existing cooling systems, or manufactured into new cooling systems as original equipment.

Cooling systems, in general, are well known in the art. Further, a person skilled in the art would understand how a cooling system, such as cooling system 200 could be configured or modified. Additionally, there can be a plurality of electrical connection points in which a system 100 could be electrically interconnected with a cooling system 200 to produce desirable results.

In an exemplary embodiment a system 100 can be interconnect between a temperature control thermostat 206 and at least one of the electrical series connection between capacitor 208 and cooling system relay 214, as shown in FIG. 3. A temperature control thermostat 206 is generally referred to as a thermostat, or thermostat 206.

In an exemplary embodiment a cooling system can be implemented by electrically connecting a plurality of evaporator fans 202 in parallel with a condenser fan 204 which is in series with a thermostat 206, as shown in FIG. 3. Furthermore, a thermostat 206 can be electrically connected to a first electrical connection on a system 100.

A capacitor 208 in series with a cooling system relay 214 can be electrically connected to a second electrical connection point on a system 100. A compressor 212 can be electrically connected to the cooling system relay 214, and an overload protector 210. Power can be supplied to the cooling system as shown in FIG. 3.

An evaporator fan 202 can be a HEATCRAFT part number 3EY0703M-009.00×012.00. A temperature control thermostat 206 can be a EATON part number C0027, SPST, 125V, 16/8FLA, 80/40. A condenser fan 204 can be a GENERAL ELECTRIC part number 5KSM51AG5194. A capacitor 208 can be a MALLORY part number 2252001F. An overload protector 210 can be a KLIXON part number MRT22AIN-69. A compressor 212 can be a ASPERD part number E6187Z. A relay 214 can be a KLIXON part number 9660A-182. Similar devices can be substituted for all the parts listed above.

Figure 4:
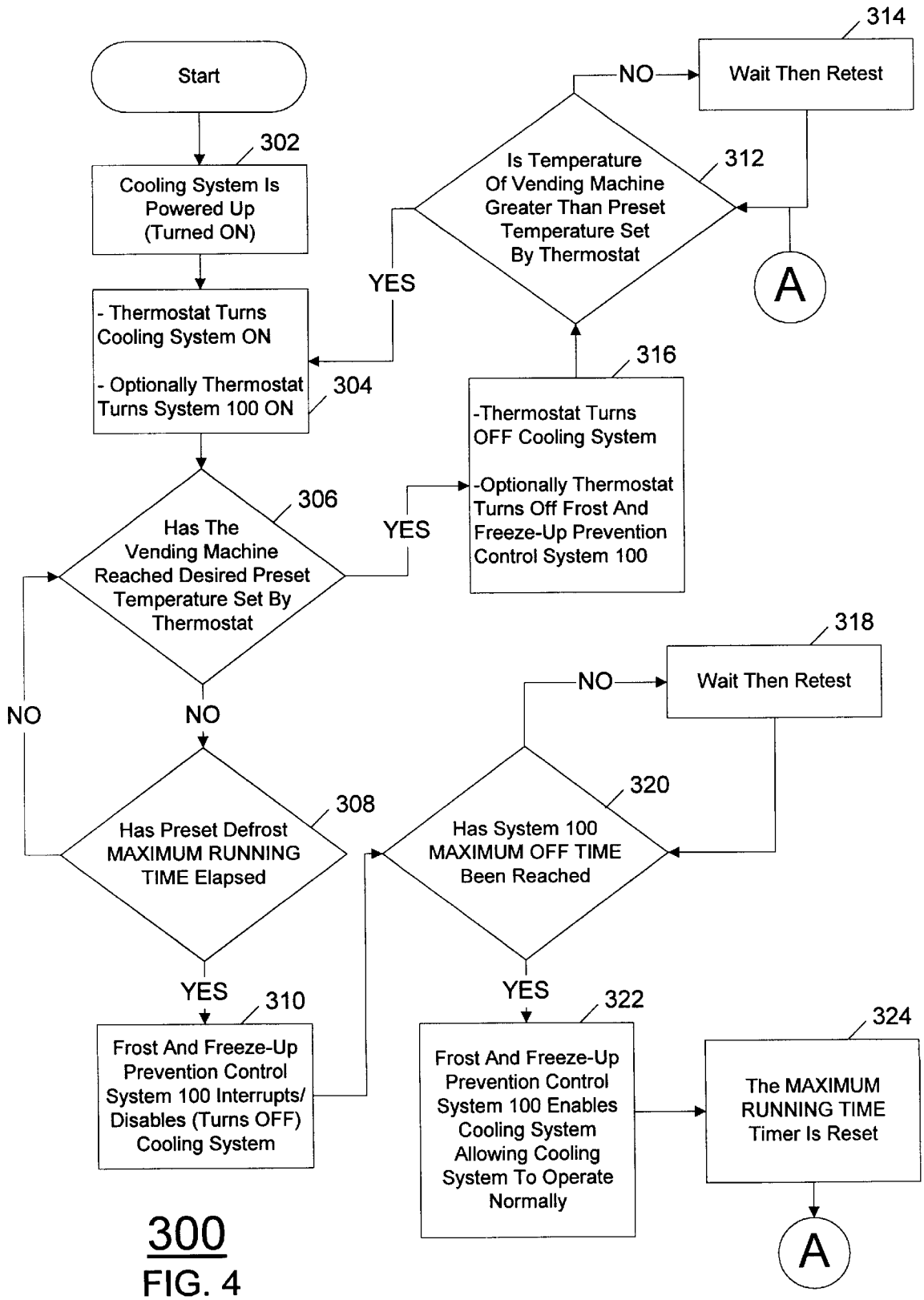
FIG. 4 shows a cooling system with a system 100 operation routine 400 flowchart.

Referring to FIG. 4 there is shown a cooling system 200 with a system 100 operation routine 300. Cooling system routine 300 is a flowchart of how a cooling system, such as cooling system 200 interconnected with a system 100 operates to improve cooling system 200 operational efficiency and to prevent frost and freeze-ups.

Processing begins in block 302 where power is first applied to the cooling system 200. Processing then moves to block 304.

System 100 can be configured to turn ON and or be initialized or reset in several different ways. First system 100 can be configured to turn ON, initialized and or reset only when the thermostat 206 is in an ON state. Subsequently system 100 turns OFF when the thermostat 206 is in an OFF state. This method is preferable and allows the thermostat 206 to act as an ON and OFF switch to the system 100.

In another exemplary embodiment a system 100 can be configured to be powered ON, OFF, initialized and or reset in accordance with the cooling system being powered ON and OFF. To clarify system 100 can receive power from, and be electrically connected to the cooling system in such a way that when the cooling system 200 turns ON, system 100 turns ON and when the cooling system 200 turns OFF, system 100 turns OFF.

In another exemplary embodiment a system 100 can be configured to be powered ON and remain ON whether the cooling system is powered ON or OFF. Further, the state of the thermostat 206 (ON or OFF) does not materially effect system 100 being powered ON. To clarify system 100 can receive continuous power while be electrically connected to the cooling system in such a way that when the cooling system turns ON, system 100 turns ON and when the cooling system turns OFF, system 100 remains ON. Further, regardless of the state of the thermostat 206 (ON or OFF) system 100 remains powered ON.

In block 304 a thermostat, such as thermostat 206 detects the temperature of the refrigerated compartment. If the measured temperature is out of range thermostat 206 turns ON the cooling system 200. Processing then moves to decision block 306.

In decision block 306 a test if performed to determine if a preset refrigerated compartment temperature set by thermostat 206 has been reached. If the resultant is in the affirmative, that is the preset temperature has been reached then processing moves to block 316. If the resultant is in the negative, that is the preset temperature has not been reached then processing moves to decision block 308.

In decision block 308 a test is performed to determine if a MAXIMUM RUNNING TIME preset in system 100 has been reached or elapsed. The MAXIMUM RUNNING TIME is the maximum amount of time the cooling system 200 is allowed to continuously run operating in a cooling mode before a forced interrupt or disabling initiated by system 100 shuts OFF cooling system 200. If the resultant is in the affirmative, that is the preset MAXIMUM RUNNING TIME has been reached or elapsed then processing moves to block 310. If the resultant is in the negative, that is the preset MAXIMUM RUNNING TIME has not been reached or elapsed then processing moves back to decision block 306.

In an exemplary embodiment the MAXIMUM RUNNING TIME can range from minutes to hours. A preferred MAXIMUM RUNNING TIME can be approximately three hours.

In block 310 system 100 turns OFF the cooling system 200 preventing frost and ice from forming on the cooling system 200 or vending machine. The formation of frost or ice in the refrigerated compartment or on the cooling system is generally referred to as freezing, or freeze-up. The cooling system can be disabled by way of cooling system relay 214 and, cooling system control means 108. Overall cooling system efficiency is maintained by not allowing frost and or freeze-up from occurring to or on cooling system 200 components. Processing then moves to decision block 320.

In decision block 320 a determination is made as to whether or not a MAXIMUM OFF TIME has been reached or elapsed. The MAXIMUM OFF TIME is the maximum time that system 100 will interrupt effectively disabling the cooling system from turning back ON and operating normally. If the resultant is in the affirmative, that is the MAXIMUM OFF TIME has been reached or elapsed then processing moves to block 322. If the resultant is in the negative, that is the MAXIMUM OFF TIME has not been reached or elapsed then processing moves to block 318 where a brief delay occurs. After the brief delay processing then moves back to block 320.

In an exemplary embodiment a MAXIMUM OFF TIME can range from minutes to hours. A preferred MAXIMUM OFF TIME can be in the range of twenty to thirty minutes.

In block 322 system 100 reestablishes normal operation status to the cooling system 200. Normal operation can be reestablished by way of relay 214, and cooling system control means 108. Processing then moves to block 324 where the MAXIMUM RUNNING TIME timer is reset. Processing then moves to decision block 312.

In block 316 thermostat 206 turns OFF the cooling system 200. System 100 may be electrically connected to the cooling system 200 in such a way that when thermostat 206 turns OFF the cooling system 200, system 100 also turns OFF. In which case when thermostat 206 turns ON the cooling system, system 100 turns ON, initializes, resets and resumes normal operation. Processing then moves to decision block 312.

In another exemplary embodiment system 100 can be electrically connect to the cooling system 200 in such a way that when thermostat 206 turns OFF the cooling system 200, system 100 remains powered ON and continues to function as normally—initializing and resetting as necessary.

In decision block 312 a test is performed to determine if the refrigerated compartment temperature is above the preset temperature preset by thermostat 206. If the resultant is in the affirmative, that is the refrigerated compartment temperature is greater than the preset temperature set by thermostat 206 then processing moves to block 304. If the resultant is in the negative, that is the refrigerated compartment temperature is not greater than the preset set temperature set by thermostat 206 then processing moves to block 314. Processing in block 314 is a brief delay. Processing is then returned to decision block 312.

Figure 5:
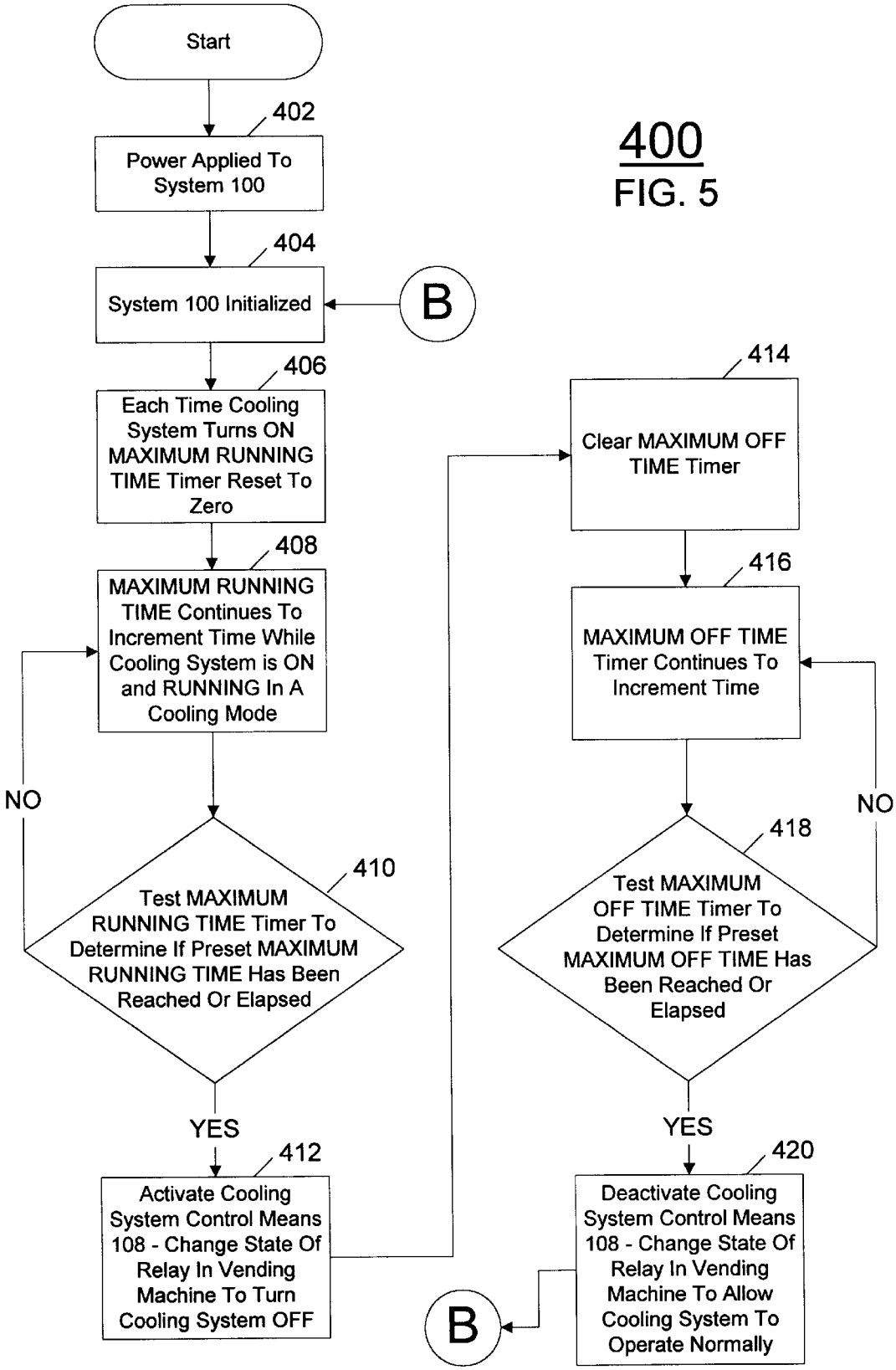
FIG. 5 shows a frost control system 100, system routine flowchart.

Referring to FIG. 5 there is shown a system 100 operation routine 400 flowchart. In an exemplary embodiment system 100 can perform the following steps to insure frost and freeze-up does not occur in a vending machine or on a cooling system, such as a cooling system 200. Processing begins in block 402 where power is applied to system 100. Processing then moves to block 404.

In block 404 initial system conditions are set and system 100 is initialized. Further, system 100 begins normal operation. Processing then moves to block 406.

In block 406 a MAXIMUM RUNNING TIME timer is reset to zero each time cooling system 200 turns ON by way of thermostat 206 and then allowed to begin accruing time. Processing then moves to block 408.

In block 408 the MAXIMUM RUNNING TIME timer continues to increment time while the cooling system in which system 100 is retrofit onto or originally manufactured into, is ON and running in an attempt to cool the vending machine refrigerated compartment area. Processing then moves to decision block 410.

In decision block 410 a test is performed to determine if the MAXIMUM RUNNING TIME timer has reached a preset time or total elapsed time count. If the resultant is in the affirmative, that is the MAXIMUM RUNNING TIME has reached a preset time or total elapsed time then processing moves to block 412. If the resultant is in the negative, that is the MAXIMUM RUNNING TIME has not reached a preset time or elapsed time then processing returns to block 408.

Processing in block 412 activates cooling system control means 108, by way of microcontroller 102. The resultant is that cooling system relay 214 change states and the cooling system 200 is interrupted, effectively disabling (turned OFF), preventing frost or freeze-up from occurring. In this processing step turning the cooling system 200 OFF, by way of system 100, does not remove power from system 100. As a result system 100 continues to operate normally. Processing then moves to block 414.

In block 414 a MAXIMUM OFF TIME is reset to zero and then allowed to begin accruing time. Processing then moves to block 416.

In block 416 the MAXIMUM OFF TIME timer continues to increment time while the cooling system 200 in which system 100 is retrofit onto, or originally manufactured into, is turned OFF and idle. Processing then moves to decision block 418.

In decision block 418 a test is performed to determine if the MAXIMUM OFF TIME timer has reached a preset time or total elapsed time count. If the resultant is in the affirmative, that is the MAXIMUM OFF TIME has reached a preset time or total elapsed time then processing moves to block 420. If the resultant is in the negative, that is the MAXIMUM OFF TIME has not reached a preset time or elapsed time then processing returns to block 416.

Processing in block 420 deactivates cooling system control means 108, by way of microcontroller 102. The resultant is that cooling system relay 214 change states and the cooling system 200 is allowed to operate normally. Processing then moves back to block 404.

While this invention has been described with reference to specific embodiments, it is not necessarily limited thereto. Accordingly, the appended claims should be construed to encompass not only those forms and embodiments of the invention specifically described above, but to such other forms and embodiments, as may be devised by those skilled in the art without departing from its true spirit and scope.

What is claimed is:

1. A frost and freeze-up prevention control system for improving the efficiency of a cooling system by preempting a said cooling system cooling cycle to prevent the formation of frost, or ice on said cooling system comprising:

a microcontroller; and a cooling system control means for monitoring and controlling said cooling system responsive to said microcontroller, said cooling system control means being electrically connected at a first point to said cooling system thermostat and at a second point to said cooling system relay, wherein said cooling system control means is electrically connected in series between said cooling system thermostat and said cooling system relay, such that an electrical signal from said cooling system thermostat is interruptible and controllable by said cooling system control means;

wherein, said frost and freeze-up prevention control system by way of said cooling system control means limits the amount of said cooling system MAXIMUM RUNNING TIME to prevent the formation of frost, or ice on said cooling system, said frost and freeze-up prevention control system also controls said cooling system MAXIMUM OFF TIME to allow ambient temperature to warm said cooling system components susceptible to the formation of frost or ice.

2. The frost and freeze-up prevention control system in accordance with claim 1 having a preset MAXIMUM RUNNING TIME period, wherein said cooling system is disabled by way of said cooling system control means when said cooling system has continuously operated in a cooling mode for a duration of the preset MAXIMUM RUNNING TIME period.

3. The frost and freeze-up prevention control system in accordance with claim 2 having a preset MAXIMUM RUNNING TIME period of approximately three hours.

4. The frost and freeze-up prevention control system in accordance with claim 1 having a preset MAXIMUM OFF TIME period, wherein said cooling system upon being initially disabled by said cooling system control means remains disabled for a duration of the preset MAXIMUM OFF TIME period.

5. The frost and freeze-up prevention control system in accordance with claim 4 having a preset MAXIMUM OFF TIME period in the range of approximately twenty to thirty minutes.

6. The frost and freeze-up prevention control system in accordance with claim 1 further comprising:

a humidity sensor interconnected with said microcontroller for monitoring humidity levels in proximity to said cooling system.

7. The frost and freeze-up prevention control system in accordance with claim 1 further comprising:

an input/output interface interconnected with said microcontroller for general-purpose system inputs and outputs.

8. The frost and freeze-up prevention control system in accordance with claim 1 further comprising:

a keypad interconnected with said microcontroller for receiving user input.

9. The frost and freeze-up prevention control system in accordance with claim 1 further comprising:

a printer interface interconnected with said microcontroller for printing general system data, reports, and other data.

10. The frost and freeze-up prevention control system in accordance with claim 1 further comprising:

a data communication interface interconnected with said microcontroller for data communicating to other data communicating devices.

11. The data communication interface in accordance with claim 10 further comprising:

an RS232 serial communication interface for data communicating to other data communicating devices.

12. The data communication interface in accordance with claim 10 further comprising:

an RS485 communication interface for data communicating to other data communicating devices.

13. The data communication interface in accordance with claim 10 further comprising:

a modem for data communicating to a remote location.

14. The data communication interface in accordance with claim 10 further comprising:

a carrier current interface for data communicating to other data communicating devices.

15. The frost and freeze-up prevention control system in accordance with claim 1 further comprising:

a memory storage device interconnected with said microcontroller for storing system settings, program code, and other data.

16. The frost and freeze-up prevention control system in accordance with claim 1 further comprising:

a cooling system monitor interconnected with said microcontroller for monitoring the performance and operation of said cooling system.

17. A method of improving the operational efficiency of a cooling system by preempting a said cooling system cooling cycle to prevent the formation of frost, or ice on said cooling system, and controlling a said cooling system off time period to allow ambient temperature to warm said cooling system components susceptible to frost or ice comprising the steps of:

a) monitoring the total time a cooling system is in a cooling mode of operation;

b) determining when a MAXIMUM RUNNING TIME period has been reached or elapsed, said MAXIMUM RUNNING TIME period being an amount of time before preempting a said cooling system cooling cycle to prevent the formation of frost, or ice on said cooling system;

c) changing the state of a cooling system control means to disable said cooling system by interrupting an electrical signal between said cooling system thermometer and said cooling system relay;

d) determining when a MAXIMUM OFF TIME period has been reached or elapsed, said MAXIMUM OFF TIME period being an amount of time to allow ambient temperature to warm said cooling system components; and e) changing the state of said cooling system control means to enable normal operation of said cooling system.

18. The step of changing the state of a cooling system control means to disable said cooling system in accordance with claim 17 further comprising the step of:

a) changing the state of a cooling system relay.

19. The step of changing the state of said cooling system control means to enable normal operation of said cooling system in accordance with claim 17 further comprising the step of:

a) changing the state of a cooling system relay.

20. The step of determining when a MAXIMUM RUNNING TIME period has been reached or elapsed in accordance with claim 17 further comprising the steps of:

a) determining said MAXIMUM RUNNING TIME period; and b) comparing said MAXIMUM RUNNING TIME to the total time said cooling system is in a cooling mode of operation.

21. The step of determining said MAXIMUM RUNNING TIME period in accordance with claim 20, wherein said MAXIMUM RUNNING TIME is approximately three hours.

22. The step of determining when a MAXIMUM OFF TIME period has been reached or elapsed in accordance with claim 17 further comprising the steps of:

a) determining said MAXIMUM OFF TIME period; and b) comparing said MAXIMUM OFF TIME to the total time said cooling system is disabled.

23. The step of determining said MAXIMUM OFF TIME period in accordance with claim 22, wherein said MAXIMUM OFF TIME is in the range of approximately twenty to thirty minutes.

* * * * *